US006748739B1

(12) United States Patent
Hirano et al.

(10) Patent No.: US 6,748,739 B1
(45) Date of Patent: Jun. 15, 2004

(54) HYDRAULIC POWER SYSTEM

(75) Inventors: Kenichi Hirano, Kanagawa (JP); Toshio Hashimoto, Kanagawa (JP); Shiro Hattori, Kanagawa (JP); Koichi Ohba, Kanagawa (JP)

(73) Assignee: Yuken Kogyo Kabushiki Kaisha, Fujisawa (JP)

( * ) Notice: Subject to any disclaimer, the term of this patent is extended or adjusted under 35 U.S.C. 154(b) by 26 days.

(21) Appl. No.: 10/031,016

(22) PCT Filed: Jul. 14, 2000

(86) PCT No.: PCT/JP00/04751

§ 371 (c)(1),
(2), (4) Date: Jan. 10, 2002

(87) PCT Pub. No.: WO01/06126

PCT Pub. Date: Jan. 25, 2001

(30) Foreign Application Priority Data

Jul. 14, 1999 (JP) ..... 11-200183

(51) Int. Cl.[7] ..... F16D 31/02
(52) U.S. Cl. ..... 60/431; 417/44.2
(58) Field of Search ..... 60/431; 417/43, 417/44.1, 44.2

(56) References Cited

U.S. PATENT DOCUMENTS 4,118,149 A * 10/1978 Hagberg ..... 60/431
4,801,247 A 1/1989 Hashimoto et al.

FOREIGN PATENT DOCUMENTS

| | | |
|---|---|---|
| JP | 62-55483 A | 3/1987 |
| JP | 10-131865 A | 5/1998 |
| JP | 10-131867 A | 5/1998 |

* cited by examiner

*Primary Examiner*—Edward K. Look
*Assistant Examiner*—Michael Leslie
(74) *Attorney, Agent, or Firm*—Frishauf, Holtz, Goodman & Chick, P.C.

(57) ABSTRACT

A hydraulic power system includes a reversible pump, a variable-speed servomotor for driving the pump, a pressure sensor for detecting load pressure, a detector for detecting the motor speed, signal command units for generating pre-programmed pressure and flow rate commands, a rotational speed controller and a signal processor. The signal processor preferentially outputs a speed command corresponding to the flow rate command by a limiter operation when the difference signal between the pressure command and the pressure detection signal is higher than a predetermined level, whereas it preferentially outputs a speed command corresponding to the difference signal when the difference signal is equal to or lower than said level. The rotational speed controller controls the magnitude of a driving current supplied to the servomotor by a closed loop on the basis of the speed command and the detected signal so that the speed of the servomotor corresponds to the speed command.

5 Claims, 1 Drawing Sheet

HYDRAULIC POWER SYSTEM

This application is a U.S. National Phase Application under 35 USC 371 of International Application PCT/JP00/04751 (not published in English) filed Jul. 14, 2000.

TECHNICAL FIELD

The present invention relates to a hydraulic power system for supplying an operational fluid of a controlled flow rate and/or controlled pressure to a load line leading to a plurality of hydraulic actuators from a reservoir and vice versa.

BACKGROUND ART

U.S. Pat. No. 4,801,247 describes a variable displacement piston pump of the type in which its output flow and output pressure are electrically controlled by a proportional electro-hydraulic control valve. In this conventional hydraulic pump, the hydraulic pressure acting on a control piston and opposing to a spring force is controlled by the proportional electro-hydraulic control valve so as to adjust the tilt angle of a swash plate arranged inside the pump by the displacement of the control piston. In a flow control mode, the control valve is energized by an input current corresponding to the difference between a flow command signal and a flow detection signal to communicate the pressure chamber of the control piston with a pump discharge port or a tank line with an opening proportional to the input current. When the output pressure reaches a certain predetermined pressure value, the control mode is changed to a pressure control mode and the tilt angle of the swash plate is controlled in the vicinity of a cutoff position. This conventional control system relied on the tit angle of the swash plate is advantageous in that both the flow control and the pressure control are effected by the single proportional electro-hydraulic control valve thereby smoothly effecting changeover between the flow control mode and the pressure control mode. In this conventional hydraulic pump, however, the hydraulic control system for controlling the tit angle of the swash plate is complicated in construction so that the flow control characteristics in the low pressure region are deteriorated and the driving motor must always be rotated during the operation of the pump irrespective of the presence or absence of output flow thus giving rise to a problem that the pump is disadvantageous from the standpoint of energy loss.

Japanese Laid-Open Patent Application No. 10-131865 describes a hydraulic pump of the type in which its rotational speed is controlled by a servomotor to supply a hydraulic fluid of a flow rate corresponding to the rotational speed. The servomotor is controlled by an inverter in accordance with the difference between a speed command signal and a rotational speed detection signal. The pump output pressure is detected by a pressure detector and also the difference between a pressure command signal and a pressure detection signal is detected. The detected pressure difference signal is combined with a non-proportional function signal produced according to the rotational speed detection signal so that a smaller one of the resulting sum value and a flow command value is used as a speed command signal. This pump control system relied on the rotational speed is disadvantageous in that there is a limitation to the changeover stability and continuity due to the addition of a non-proportional function signal to a pressure command signal for the purpose of changeover between the flow control and pressure control modes for the rotational speed control loop of the servomotor and that this control system is inferior in response characteristic to the swash plate tilt angle control system due to the driving of the servomotor by the inverter control.

DISCLOSURE OF INVENTION

It is the primary object of the present invention to provide a hydraulic power system capable of realizing control characteristics which are more excellent than those of the previously mentioned prior art.

It is another object of the present invention to provide a hydraulic power system capable of realizing a stable and smooth changeover between control modes and higher response characteristics by the use of a hydraulic pump which is relatively simple in construction and easy in maintenance.

According to a preferred embodiment of the present invention, the foregoing objects can be accomplished by a hydraulic power system for supplying hydraulic fluid of a controlled flow rate and/or controlled pressure from a reservoir to a load line communicating with a hydraulic actuator or vice versa, said system comprising:

a reversible hydraulic pump motor having a rotary shaft and adapted to serve as a hydraulic pump for feeding the fluid at a flow rate corresponding to the rotational speed of the rotary shaft rotating in a forward direction when feeding the fluid to the load line from the reservoir and to serve as a hydraulic motor for rotating the rotary shaft in a reverse direction at a rotational speed corresponding to the flow rate of the fluid when feeding the fluid to the reservoir from the load line, a variable-speed servomotor having a driving shaft coupled to the rotary shaft in a torque transmitting manner, the driving shaft being rotatable in either of the forward direction and the reverse direction with both a rotational speed and a rotation direction corresponding to the driving current supplied to the servomotor, pressure detecting means for generating a first electric signal corresponding to the fluid pressure in the load line, rotational speed detecting means for generating a second electric signal corresponding to the rotational speed of the driving shaft, signal command means for generating a preprogrammed pressure signal and a preprogrammed flow command signal, signal processing means for preferentially generating a speed command signal of a magnitude corresponding to the flow command signal by a limiter operation when a pressure difference signal corresponding to the difference between the pressure command signal and the first signal is higher than a predetermined limiting level and for preferentially generating a speed command signal of a magnitude corresponding to the pressure difference signal when the pressure difference signal is equal to or lower than the limiting level, and rotational speed control means responsive to the speed command signal and the second signal for controlling the magnitude of the driving current supplied to the servomotor through a closed feedback loop of the rotational speed so that the rotational speed of the servomotor corresponds to the speed command signal.

The hydraulic power system according to the present invention is usable in applications in which a hydraulic power is supplied to a machinery including a hydraulic actuator requiring a continuous and smooth changeover between the respective modes of flow control and pressure control, e.g., an injection molding machine, hydraulic press machine, hydraulic press fitting machinery, hydraulic bending machine and the like. In these machines, an energy is inputted in the form of an electric energy which is converted to a hydraulic power by the hydraulic power system of the present invention and this hydraulic power is substantially coincident with the desired values of a flow rate and a pressure to be supplied to the actuator in the respective operating phases of the machine. Thus, by using the hydraulic power system of the present invention, there is no need to use the electro-hydraulic proportional control valve required for controlling these desired values in the conventional systems.

The hydraulic power system according to the present invention employs the reversible hydraulic pump motor which functions as a hydraulic pump during its forward rotation and which functions as a hydraulic motor during its reverse rotation. While a variable displacement type can be used for this hydraulic pump motor, preferably use is made of a fixed displacement type which is relatively simple in pump construction and easy in maintenance. The variable-speed servomotor having the driving shaft connected to the rotary shaft of the hydraulic pump motor in a torque transmitting manner is also a reversible type and preferably a magnet-field synchronous AC servomotor can be used for it.

In the hydraulic power system according to the present invention, control commands are respectively supplied in the form of a pressure command signal and flow command signal which are preprogrammed according to the respective operating sequences of the hydraulic actuator from the signal command means that can be composed for example of a programmable controller or computer. The detector means for the controlled variables are composed of pressure detecting means for generating a first electric signal corresponding to the fluid pressure in the load line communicating with the hydraulic actuator and rotational speed detecting means for generating a second electric signal corresponding to the rotational speed of the driving shaft of the servomotor. Preferably a semiconductor pressure transducer can be used for the pressure detecting means and preferably a rotary encoder can be used for the rotational speed detecting means.

In the hydraulic power system according to the present invention, the control system of the servomotor includes in combination a first feedback loop forming a minor loop for rotational speed control system with a negative feedback signal corresponding to the rotational speed of the hydraulic pump motor and a second feedback loop forming an outer loop of the minor loop for pressure control system with a negative feedback signal corresponding to the fluid pressure in the load line. The principal parts of the rotational speed control system are included in the rotational speed control means and the principal parts of the pressure control system are included in the signal processing means.

According to another advantageous embodiment of the present invention, the rotational speed control means includes means for generating a rotational speed difference signal corresponding to the difference between the speed command signal and the second signal, torque limiter means for limiting the upper and lower limits of the rotational speed difference signal to come within a predetermined range, and current control means for receiving the rotational speed difference signal limited by the torque limiter means as a control input and the second signal as a feedback signal to feedback control the magnitude of the driving current to be supplied to the servomotor.

According to still another advantageous embodiment of the present invention, the signal processing means includes difference signal detecting means for receiving the pressure command signal at its positive input and the first signal at its negative input to generate a pressure difference signal corresponding to the difference between the two input signals, signal limiter means for producing an output signal of a magnitude corresponding to the pressure difference signal when the pressure difference signal is equal to or less than the limiting level and for holding the magnitude of said output signal at a given level when the pressure difference signal is higher than the limiting level, and means for generating a signal corresponding to the sum or the product of the flow command signal and the output signal of the signal limiter means as the speed command signal.

In a condition where the hydraulic fluid pressure in the load line is less than the pressure command, the controlled deviation or the pressure difference signal corresponding to the difference between the first signal generated from the pressure detecting means and the pressure command signal has a high value exceeding the limiting level. The signal processing means gives preference to the flow command by a limiter operation so that the speed command signal varying in response to the flow command signal is applied to the rotational speed control means. In this condition, the pressure difference signal is held at a fixed value equal to the limiting level by the limiter operation so that the control command for the control system of the servomotor is governed by the flow command signal and the rotational speed control means controls the rotational speed of the servomotor in such a manner that the flow command signal and the feedback signal from the rotational speed detecting means substantially coincide with each other. This condition is the flow control mode.

Here, in accordance with the present invention the term "preferential" means that in the flow control mode the flow command signal becomes predominant in the speed command signal applied to the rotational speed control means, that is, the speed command signal includes the flow command signal as a control command and the pressure difference signal of a fixed value equal to the limiting level.

On the other hand, when the fluid pressure in the load line reaches the pressure command, the controlled deviation or the pressure difference signal corresponding to the difference between the first signal generated from the pressure detecting means and the pressure command signal assumes a low value of less than the limiting level so that the signal processing means gives preference to the pressure difference signal and the speed command signal varying in response to the pressure difference signal is applied to the rotational speed control means. In this condition, the control command for the control system of the servomotor is governed by the pressure difference signal and the control system forms a pressure control feedback loop including in series the rotational speed control system as a minor loop. Thus, the continuity is ensured for the speed command between this pressure control mode and the flow control mode and the rotational speed control means controls the rotational speed of the servomotor in such a manner that the pressure difference signal and the feedback signal from the rotational speed detecting means substantially coincide with each other. This condition is the pressure control mode.

In accordance with the present invention, the foregoing mode changeover operation, that is, the operation of changing the speed command signal from the flow command signal to the pressure difference signal or vice versa is effected continuously and smoothly owing to the fact that the continuity of the speed command is maintained between the two modes by the limiter operation as mentioned previously, that also in the flow control mode the pressure difference signal is included with a fixed value equal to the limiting level in the speed command signal, and that the pressure difference signal varies between the limiting level and a lower level without overshooting during the bidirectional transfer between the flow control mode and the pressure control mode. To achieve this changeover operation by the selection operation or the switching operation as in the conventional manner is not preferable since there is the possibility that the changeover between the control modes becomes discontinuous. It is to be noted that to additionally provide means for causing the pressure difference signal to follow up the flow command when the control system is in the flow control mode is preferable from the standpoint of more smoothly effecting the changeover between the modes without any shock.

With the hydraulic power system according to the present invention, the control of the rotational speed of the servomotor can be effected for both the forward rotation and the reverse rotation so that the control can be effected electronically in both cases where the hydraulic pump motor is rotated in the forward direction so as to feed the hydraulic fluid of the desired flow rate to the load line and also to control its pressure at the desired value and where the hydraulic pump motor is rotated in the reverse direction so as to reduce the fluid pressure in the load line according to the optimum pressure reducing speed pattern. It is of course possible to control the hydraulic pump motor at an extremely low rotational speed or in its substantially halting state and thus the control is stable even in the low pressure region of the load pressure.

With the hydraulic power system according to the present invention, in the pressure control mode the fluid pressure in the load line is detected by the pressure detecting means and the resulting pressure detection signal acts effectively as a feedback signal on the closed control system. As a result, the fluid pressure is subjected to the closed control even if the temperature of the fluid changes from the normal operating temperature, thereby automatically making the fluid temperature compensation effective. On the other hand, in the flow control mode the fluid pressure is subjected to the open-loop control so that when there occurs any change in the pressure due to a fluid temperature change, it appears as a change of the flow rate for the hydraulic actuator.

In accordance with still another advantageous embodiment of the present invention, the system further includes fluid temperature detecting means for detecting the temperature of the hydraulic fluid to produce a third electric signal of a magnitude corresponding thereto, and temperature compensation means for applying to the flow command signal or the speed command signal a correction amount equivalent to a variation of the temperature detected by the fluid temperature detecting means with respect to a predetermined reference temperature.

The fluid temperature detecting means can be arranged at an arbitrary position in the hydraulic circuitry including the hydraulic fluid reservoir, the hydraulic pump motor, the load line and the hydraulic actuators. The fluid temperature compensation is effected by detecting the difference (variation) between the fluid temperature detected by the fluid temperature detecting means and the reference temperature (presettable to any given temperature) and adding to the flow command signal a signal correction amount equivalent to a flow variation (determined by the characteristics of the fluid used) corresponding to the detected variation. It is to be noted that this signal correction amount may be added to the speed command signal and in this case the fluid temperature compensation is made effective not only in the flow control mode but also in the pressure control mode.

In accordance with still another advantageous embodiment of the present invention, the system further includes correction means for correcting the flow command signal with the first signal to compensate a variation in the pump volumetric efficiency. This correction means can be constituted by a differential operational amplifier which receives the flow command signal at its positive input terminal and the first signal from the pressure detecting means at its negative input terminal with a suitable correction factor. In the flow control mode, as for example, a compensation is provided for a drop in the pump volumetric efficiency due to such cause as an increased leakage flow within the pump due to an increase in the load pressure.

In accordance with still another advantageous embodiment of the present invention, the hydraulic power system further includes operating speed detecting means for producing a fourth electric signal corresponding to the operating speed of the hydraulic actuator, operation discrimination means responsive to the fourth signal to discriminate whether the actuator is in operation, and operating speed control means for additionally feeding the fourth signal back to the speed command signal and subjecting the operating speed of the actuator to the closed control only when the operation of the actuator is discriminated by the operation discrimination means.

As in the case of an injection molding machine in which the operation of a plurality of hydraulic actuators is controlled by a single hydraulic pump, for example, operating speed detecting means is arranged for the purpose of detecting the operating speed of at least particular one of the hydraulic actuators which requires a particularly highly accurate speed control in addition to the compensations for working fluid temperature variations and load pressure variations. Such operating speed detecting means can be arranged for each of the plurality of hydraulic actuators provided that in this case the operations of the respective hydraulic actuators do not overlap each other in time.

In the case of the injection molding machine, for example, the hydraulic actuator which requires the highest degree of accuracy for the operating speed control is the injection cylinder and therefore the operating speed detecting means is mounted to this injection cylinder. When the actuator having the operating speed detecting means mounted thereto (i.e., the injection cylinder) comes into operation, the operating speed detecting means produces a fourth signal. When the fourth signal is prodiced, the operation discrimination means discriminates that the particular actuator is in operation, whereas it is determined that the particular actuator is in the non-operating condition if there is no generation of the fourth signal. The operating speed control means additionally feeds the fourth signal back to the speed command signal to subject the operating speed of the particular actuator to a closed control only when the operation of the particular actuator is discriminated by the operation discrimination means. This control is effective irrespective of whether the system is in the flow control mode or in the pressure control mode.

The above and other features and advantages of the present invention will be understood more apparently from the following description of the preferred embodiments as illustrated in the accompanying drawing.

BEST MODE FOR CARRYING OUT THE INVENTION

Figure 1:
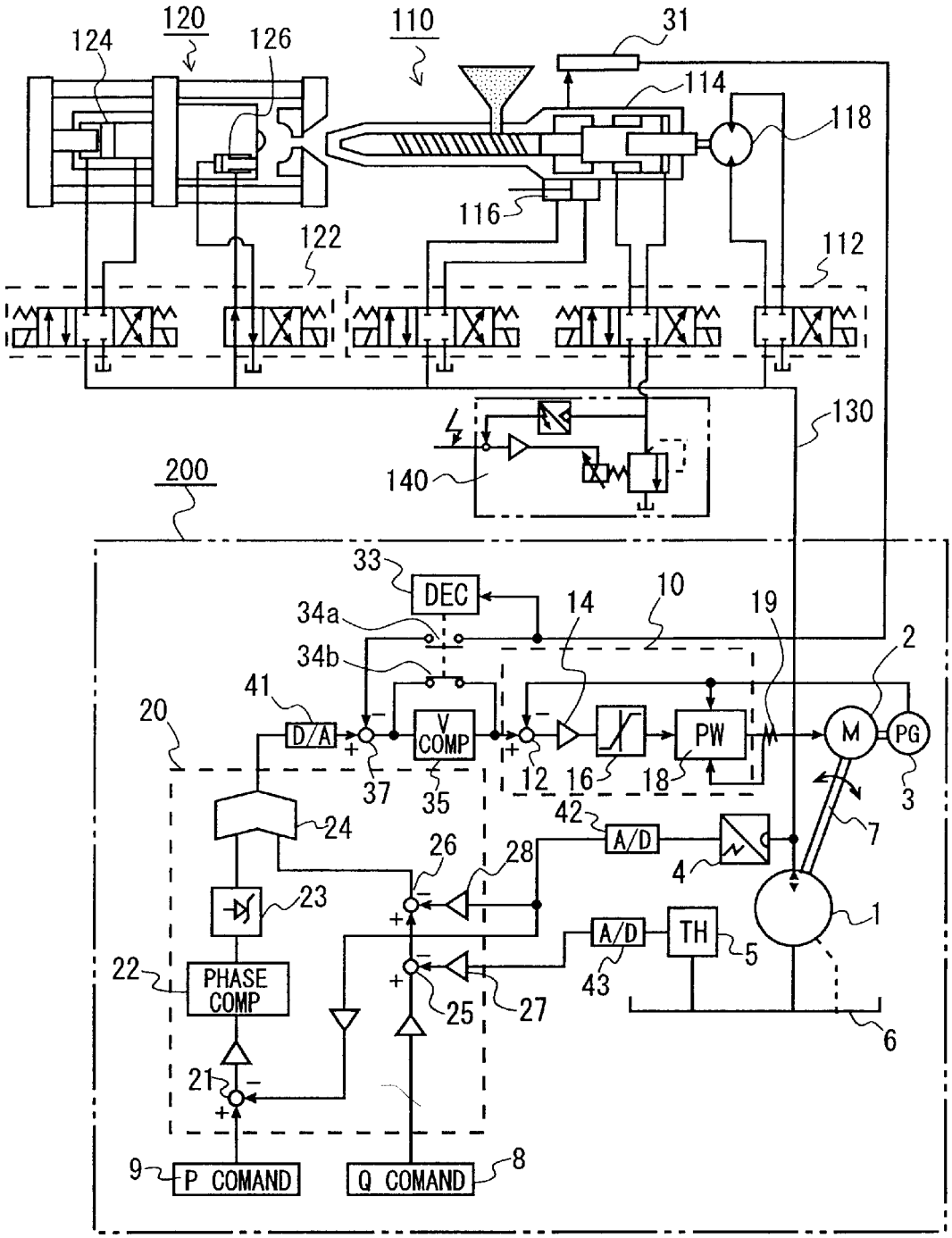
FIG. 1 is a schematic block diagram showing a nonlimiting exemplary construction of an injection molding machine equipped with a hydraulic power system according to one embodiment of the present invention.

In FIG. 1, an injection molding machine includes an injection unit 110, a clamping unit 120, and hydraulic power unit 200 for supplying a hydraulic fluid power to a load line 130 communicating with the injection unit 110 and the clamping unit 120 through electro-hydraulic directional control valve units 112 and 122, respectively.

The injection unit 110 comprises a plurality of hydraulic actuators including an injection cylinder 114, a movable cylinder 116 for forwarding/backing the injection cylinder including an injection nozzle at the front end thereof and a hydraulic motor 118 for driving a measuring screw arranged inside the injection cylinder. Also, the clamping unit 120 comprises a plurality of hydraulic actuators including a clamping cylinder 124 for opening/closing the mold and an ejector cylinder 126 for removing a molded product from the mold. These actuators are connected, on one hand, to the common load line 130 through the control valve units 112 and 122, respectively, and, on the other hand, to an oil reservoir 6. It is to be noted that the injection cylinder 114 is adapted for connection with the oil reservoir 6 through a back pressure controlling proportional electro-hydraulic relief valve 140 which is controlled independently. Also, mounted on the injection cylinder 114 of the injection unit 110 is a speed sensor 31 for detecting its cylinder operating speed to generate a corresponding electric signal (fourth signal).

In this injection molding machine, its energy is inputted in the form of an electric energy which is converted to a hydraulic power by the hydraulic power unit 200, and this hydraulic power is substantially equal to the required amounts of flow and pressure which will be supplied through the load line 130 to the respective hydraulic actuators in the individual operating phases of the sequential operations of the injection molding machine. In other words, the flow rate and pressure of the hydraulic operating fluid or oil in the load line 130 are generally controlled by the hydraulic power unit 200.

The hydraulic power unit 200 is the principal objective part of the present invention and it mainly includes, in the present embodiment, a reversible fixed displacement hydraulic pump motor 1, a variable-speed reversible AC servomotor 2 having a driving shaft 7 coupled to the rotary shaft of the pump motor in a torque transmitting manner, a rotary encoder 3 for detecting the rotational speed of the driving shaft 7, a pressure sensor 4 for detecting the fluid pressure in the load line 130 to generate a corresponding electric signal (first signal), an AC servo amplifier 10 constituting rotational speed control means for the servomotor, a signal processor 20 for generating a speed command signal applied to the servo amplifier, and signal command units 8 and 9 for respectively applying predetermined flow and pressure command signals to the signal processor 20.

The power unit 200 also includes a temperature detector 5 for detecting the temperature of the oil in the reservoir 6 to generate a corresponding electric signal (third signal).

The output flow of the hydraulic pump motor 1 is controlled by the closed loop control of the rotational speed of the servomotor 2 during the discharge and suction operations of the pump to control the various operations performed by the injection unit 110 and the clamping unit 120 and therefore this output flow is directly proportional to the rotational speed of the pump.

The closed loop control includes two principal modes one of which is the flow control mode performed by the servo amplifier 10 and the signal processor 20 in association with the rotary encoder 3 and the other is the pressure control mode performed by the servo amplifier 10 and the signal processor 20 in association with the rotary encoder 3 and the pressure sensor 4.

The sequence, timing and various quantitative values relating to the various operations performed by the injection unit 110, the clamping unit 120 and the hydraulic power unit 200 are effected under the command of a control computer in accordance with molding parameters inputted through an operational interface, and the signal command unit 8 for flow command signals and the signal command unit 9 for pressure command signals are symbolically shown in the drawing as the elements for applying these commands.

A hydraulic pump motor 1 is a fixed displacement type pump having its rotary shaft coupled to the driving shaft 7 in a torque transmitting manner so that when feeding the oil or operating fluid to the load line 130 from the reservoir 6, it operates as a hydraulic pump for feeding the oil at a flow rate corresponding to the rotational speed of the rotary shaft rotating in the forward direction, whereas when feeding the oil from the load line 130 to the reservoir 6, it operates as a hydraulic motor for rotating the rotary shaft in the reverse direction at a rotational speed corresponding to the flow rate of the oil. The rotational speed in either of the forward and reverse directions, that is, the feed amount of the oil by the pump motor 1 is controlled by the servomotor 2.

The rotary encoder 3 constitutes rotational speed detecting means for detecting the rotational speed of the driving shaft (output shaft) of the servomotor 2 to generate a corresponding electric signal (second signal).

The servo amplifier 10 forming the rotational speed control means of the servomotor 2 constitutes a closed loop control system which utilizes the rotational speed detected by the rotary encoder 3 as a feedback signal and the rotational speed command signal produced from a flow command signal and a pressure difference signal applied from the signal command units 8 and 9 as a control command. In other words, the servo amplifier 10 includes a differential operational amplifier 12 for generating a rotational speed difference signal corresponding to the difference between the speed command signal applied from the signal processor 20 through a DA converter 41 and the second signal from the rotary encoder 3, an operational amplifier 14 for applying a control factor, a torque limiter circuit 16 for limiting the upper and lower limits of the rotational speed difference signal to come into a predetermined range, and an AC current controller 18 for receiving the rotational speed difference signal limited by the torque limiter circuit as a control input and the second signal from the rotary encoder 3 as a feedback signal to feedback control the magnitude of a driving current to be supplied to the servomotor 2. Also applied to the current controller 18 is the current feedback from a current detector 19 which detects the magnitude of the driving current. The servomotor 2 rotates in the forward direction or the reverse direction with the rotational speed and the rotation direction corresponding to the driving current controlled by the current controller 18.

The pressure sensor 4 may be comprised of a semiconductor gage type pressure sensor mounted within the body or cover of the pump motor 1 and it always detects the oil pressure in the load line 130 communicating with either one of the ports of the pump motor 1.

The signal processor 20 receives a flow command signal and a pressure command signal in their digital signal forms from the signal command units 8 and 9, respectively, at the stage of each phase in the operating cycle of the injection molding machine, and it also receives the feedback signal (first signal) from the pressure sensor 4 through an AD converter 42 at all times. The signal processor 20 preferentially outputs a speed command signal corresponding to the flow command signal from the signal command unit 8 through a limiter operation when a predetermined limiting level is exceeded by the pressure difference signal corresponding to the difference between the pressure command signal from the signal command unit 9 and the first signal from the pressure sensor 4, whereas it preferentially outputs a speed command signal of a magnitude corresponding to the pressure difference signal when the pressure difference signal is below the limiting level. In the present embodiment, the signal processor 20 is comprised of a digital system and all of its required functions can be realized by means of a software program. As shown in the drawing as its functional elements, the signal processor 20 according to the present embodiment includes mainly a difference signal detecting element 21 which receives the pressure command signal from the signal command unit 9 at its positive input and the digitized first signal from the pressure sensor 4 through the AD converter 42 at its negative input to generate a pressure difference signal corresponding to the difference therebetween, a phase compensation element 22 for compensating the thus obtained pressure difference signal with a predetermined phase shift value, a signal limiter element 23 for generating an output signal of a magnitude corresponding to the pressure difference signal from the phase compensation element 22 when the pressure difference signal is equal to or lower than the limiting level and for holding said output signal to a fixed level when the pressure difference signal is higher than the limiting level, and a computing element 24 for producing a signal corresponding to the sum or the product of the flow command signal from the signal command unit 8 and the output signal of the signal limiter element 23 to apply the same as the speed command signal to the DA converter 41.

The signal processor 20 further includes a correcting element 25 provided in the flow command signal system for the purpose of providing a compensation for a change in the temperature of the operating oil.

The correcting element 25 receives a third signal corresponding to the current temperature of the oil detected by the temperature detector 5 as a digital signal through an AD converter 43 and a scale-factor element 27. This digital signal corresponds to the amount of flow compensation equivalent to a variation of the detected temperature with respect to a reference temperature (this reference temperature is preliminarily set in the signal processor 20 as an arbitrary temperature, e.g., the room temperature at the time of an initializing operation of the system) due to the function of the signal processor 20 itself. The correcting element 25 generates an output corresponding to the difference between the flow command signal and the flow compensation amount.

Now considering the compensating operation by the correcting element 25 in greater detail, the compensation of the flow command is the processing operation of subtracting the compensation amount Qc1 obtained from the following equation from the flow command.

$$Qc1=Gt\times(T-Ts)/Ts$$

Here, T is the detected fluid temperature, Ts is the reference temperature and Gt is the compensation gain.

The reference temperature Ts is determined preliminarily and the compensation gain Gt is the characteristic factor determined in accordance with the various data including the volume of the hydraulic pump motor 1 used and the characteristics of the operating fluid used. Thus, according to the present embodiment, the fluid temperature is detected by the temperature detector 5 and a compensation amount based on the resulting fluid temperature variation is applied to the flow command signal by the correcting element 25, with the result that no error is involved in the controlled flow rate based on the temperature variation of the operating fluid in spite of the flow control by the pump rotational speed control, thereby ensuring the highly accurate control.

It is to be noted that while, in the present embodiment, the correcting element 25 applies a compensation amount to the flow command signal, it is possible to apply a compensation amount to the speed command signal generated from the computing element 24 and in this case the fluid temperature compensation can also be accomplished in the pressure control mode.

In the signal processor 20 according to this embodiment, disposed further in the flow command signal system is a correcting element 26 for providing a compensation for a variation of the pump volumetric efficiency corresponding to a variation of the operating fluid pressure in the load line in accordance with the first signal from the pressure sensor 4. Here, the compensation of the pump volumetric efficiency means the provision of a compensation for a phenomenon in which the flow of the operating fluid fed to the load line 130 is decreased with an increase in the internal leakage flow of the hydraulic pump motor 1 due to an increase in the load pressure, for example. The correcting element 26 receives the first signal corresponding to the current pressure of the operating fluid in the load line 130, which pressure is detected by the pressure sensor 4, through the AD converter 42 and a scale-factor element 28 as a digital signal. This digital signal corresponds to a flow compensation amount equivalent to a variation of the detected pressure with respect to a reference pressure (this reference pressure is determined by the various data inherent to the hydraulic pump motor used) due to the function of the signal processor 20. The correcting element 26 generates an output corresponding to the difference between the flow command signal and the flow compensation amount.

Explaining the compensation operation by the correcting element 26 in a greater detail, the compensation of the flow command is the operation of subtracting the compensation amount Qc2 obtained from the following equation from the flow command.

$$Qc2=Gp\times(P-Ps)/Ps$$

Here, P is the detected pressure, Ps is the reference pressure and Gp is the compensation gain.

In this way, the correcting element 26 applies to the flow command signal a flow compensation amount corresponding to the detected pressure to provide a compensation for a variation of the pump volumetric efficiency due to the pressure variation.

In the present embodiment, the operating speed of the injection cylinder 114 is further detected by the speed sensor 31 and it is applied to the control system. The power unit 200 includes a discriminator or DEC 33 for deciding whether the injection cylinder 114 is in operation according to the detection signal of the speed sensor 31, and the discriminator 33 includes relay switches 34*a* and 34*b* which are each comprised of a semiconductor switching element. In the condition where no signal is arriving from the speed sensor 31, the discriminator 33 moves the switch 34*a* into an OFF state and the switch 34*b* into an ON state, i.e., the illustrated switched positions, whereas when the signal arrives from the speed sensor 31, the switch 34*a* is turned on and the switch 34*b* is turned off, i.e., these switches are changed over from the illustrated switched positions. Arranged in series between the output of the DA converter 41 and the input of the servo amplifier 10 are a differential operational amplifier 37 for feeding the detection signal of the speed sensor 31 back to the speed command signal from the DA converter 41 and an operating speed controller 35 for receiving the output signal of the operational amplifier 37 to perform the compensating operation required for the closed control on the operating speed of the injection cylinder. This operating speed controller 35 is made effective only when the signal from the speed sensor 31 arrives at the discriminator 33 so that the switch 33*a* is turned on and the switch 33*b* is turned off.

While the speed sensor 31 detects the operating speed of the injection cylinder 114 which requires an especially highly accurate control, if necessary, the similar speed sensors may be provided for the other hydraulic actuators which do not overlap in time with the operating phases of the injection cylinder 114 so as to effect the closed control of the operating speeds.

When the piston of the injection cylinder 114 is at a stop, the sensor 31 is generating no detection signal. In this condition, the discriminator 33 holds the switches 34*a* and 34*b* in the OFF and ON states, respectively, and the controller 35 is by-passed by the switch 34*b*. Thus, the speed command signal from the DA converter 41 is directly applied to the servo amplifier 10.

On the other hand, as the piston of the injection cylinder 114 comes into movement, the speed sensor 31 generates a detection signal. The discriminator 33 receives this detection signal so that the switches 34*a* and 34*b* are switched into their ON and OFF positions, respectively. When this occurs, the detection signal of the speed sensor 31 reaches the negative input of the differential operational amplifier 37 through the switch 34*a* and it is applied as a negative feedback signal to the speed command signal from the DA converter 41. Also, due to the fact that the switch 34*b* is now turned off, the controller 35 becomes effective. The differential operational amplifier 37 generates a speed difference signal corresponding to the difference between the speed command signal from the DA converter 41 and the operating speed detection signal from the speed sensor 31 and this speed difference signal is introduced into the servo amplifier 10 through the controller 35.

In this way, the operating speed of the injection cylinder 114 is detected by the speed sensor 31 and the operating speed of the injection cylinder 114 is fed back to the servo control system, thereby ensuring the provision of compensation for variations of the cylinder operating speed due to variations of the load pressure during the injection operation as well as temperature variations of the hydraulic working fluid.

It is to be noted that the foregoing embodiments are intended to limit the present invention in no way and it is needless to say that any modifications obvious to those skilled in the art come into the scope of the present invention.

We claim:

1. A hydraulic power system of the type in which a hydraulic fluid of a controlled flow rate and/or controlled pressure is supplied from a reservoir to a load line communicating with a hydraulic actuator and vice versa, comprising:

a reversible hydraulic pump motor having a rotary shaft, said pump motor operating as a hydraulic pump for supplying said fluid at a flow rate corresponding to a rotational speed of said rotary shaft rotating in a forward direction when said fluid is supplied to said load line from said reservoir, said pump motor operating as a hydraulic motor for rotating said rotary shaft in a reverse direction at a rotational speed corresponding to a flow rate of said fluid when said fluid is supplied to said reservoir from said load line, a variable-speed servomotor having a driving shaft coupled to said rotary shaft in a torque transmitting manner, said driving shaft being rotatable in either of said forward and reverse directions with a rotational speed and rotational direction corresponding to a driving current supplied to said servomotor, pressure detecting means for generating a first electric signal corresponding to a pressure of said fluid in said load line, rotational speed detecting means for generating a second electric signal corresponding to the rotational speed of said driving shaft, signal command means for generating a preprogrammed pressure signal and a preprogrammed flow command signal, signal processing means for preferentially generating a speed command signal of a magnitude corresponding to said flow command signal by a limiter operation when a pressure difference signal corresponding to the difference between said pressure command signal and said first signal is higher than a predetermined limiting level and for preferentially generating a speed command signal of a magnitude corresponding to said pressure difference signal when said pressure difference signal is equal to or lower than said limiting level, and rotational speed control means responsive to said speed command signal and said second signal for controlling the magnitude of said driving current supplied to said servomotor through a closed feedback loop for the rotational speed in such a manner that the rotational speed of said servomotor corresponds to said speed command signal, wherein said rotational speed control means comprises means for generating a rotational speed difference signal corresponding to the difference between said speed command signal and said second signal, torque limiter means for limiting upper and lower limits of said rotational steed difference signal to come into a predetermined range, and current control means for receiving said rotational speed difference signal limited by said torque limiter means as a control input and said second signal as a feedback signal to feedback control the magnitude of said driving current supplied to said servomotor.

2. A hydraulic power system according to claim 1, wherein said signal processing means comprises difference signal detecting means for receiving said pressure command signal at a positive input and said first signal at a negative input to generate a pressure difference signal corresponding to the difference therebetween, signal limiter means for generating an output signal of a magnitude corresponding to said pressure difference signal when said pressure difference signal is equal to or lower than said limiting level and for holding said output signal at a fixed level when said pressure difference signal is higher than said limiting level, and means for generating a signal corresponding to a sum or product of said flow command signal and the output signal of said signal limiter means as said speed command signal.

3. A hydraulic system according to claim 1, further comprising temperature detecting means for detecting a temperature of said fluid to generate a third electric signal of a magnitude corresponding to said detected temperature, and temperature compensating means for correcting said flow command signal or said speed command signal with a compensation amount equivalent to a variation of said temperature detected by said temperature detecting means with respect to a predetermined reference temperature.

4. A hydraulic power system according to claim 1, further comprising correcting means for correcting said flow command signal with said first signal to compensate a variation of a pump volumetric efficiency.

5. A hydraulic power system according to claim 1, further comprising operating speed detecting means for generating a fourth electric signal corresponding to an operating speed of said hydraulic actuator, operation discrimination means for discriminating whether said actuator is in operation or not in accordance with said fourth signal, and operating speed control means for additionally feeding said fourth signal back to said speed command signal and thereby subjecting the operating speed of said actuator to a closed control only when the operation of said actuator is discriminated by said operation discrimination means.

* * * * *